US005718141A

United States Patent [19]

Watari

[11] Patent Number: 5,718,141

[45] Date of Patent: Feb. 17, 1998

[54] UNIVERSAL ROLLING MACHINE

[75] Inventor: Hirokazu Watari, Kobe, Japan

[73] Assignee: Kawasaki Jukogyo Kabushiki Kaisha, Kobe, Japan

[21] Appl. No.: 450,313

[22] Filed: May 25, 1995

[30] Foreign Application Priority Data

May 30, 1994 [JP] Japan ..... 6-140900

[51] Int. Cl.[6] ..... B21B 13/10; B21B 31/07; B21B 31/18

[52] U.S. Cl. ..... 72/247; 72/224; 72/225

[58] Field of Search ..... 72/224, 225, 244, 72/245, 248, 214, 246, 247

[56] References Cited

U.S. PATENT DOCUMENTS

| | | | |
|---|---|---|---|
| 4,557,130 | 12/1985 | Bond | 72/225 |
| 4,736,609 | 4/1988 | Schiller et al. | 72/245 |
| 4,803,862 | 2/1989 | Schulze et al. | 72/245 |
| 4,803,865 | 2/1989 | Jansen et al. | 72/245 |
| 4,819,507 | 4/1989 | Pescher | 72/248 |
| 5,203,193 | 4/1993 | Iguchi et al. | 72/225 |
| 5,327,761 | 7/1994 | Piasecki et al. | 72/225 |
| 5,423,201 | 6/1995 | Steinmair et al. | 72/225 |

FOREIGN PATENT DOCUMENTS

| | | | |
|---|---|---|---|
| 2102090 | 4/1972 | France . | |
| 47-49415 | 12/1972 | Japan . | |
| A-57-97807 | 6/1982 | Japan . | |
| A-4-172115 | 6/1992 | Japan . | |
| 5-261406 | 10/1993 | Japan . | |
| 1454930 | 11/1976 | United Kingdom | 72/225 |

OTHER PUBLICATIONS

Derwent Publications Ltd., English language abstract of Japanese Patent Publication No. 47–49415.

Patent Abstracts of Japan, English language abstract of Japanese Patent Publication No. 5–261406.

Orellana, "Recent Developments In Strip Thickness Control", *Iron and Steel Engineer*, Nov., 1962, pp. 71–79.

*Primary Examiner*—Lowell A. Larson
*Assistant Examiner*—Rodney Butler
*Attorney, Agent, or Firm*—Oliff & Berridge, PLC

[57] ABSTRACT

The present invention relates to a universal rolling machine wherein a pair of left and right vertical rolls, which are positioned on axial centers that intersect axial centers of a pair of upper and lower horizontal rolls, are mounted coaxially within vertical roll chocks, and the vertical roll chocks are each arranged within a housing in a freely slidable manner along a direction of rolling of a material to be rolled. Assemblies each comprising a circular cylindrical nut and a screw are arranged on either side of the vertical roll chocks along the direction of rolling in spaces between the housing and the vertical roll chocks, as a movement mechanism for the vertical roll chocks. The provision of this configuration enables the use of conventional vertical roll chocks, ensures sufficient mechanical strength with respect to the reactive forces applied to the vertical rolls during the rolling, enables a reduction in costs, and also enables a significant shortening of the time required for replacing the rolls.

8 Claims, 9 Drawing Sheets

UNIVERSAL ROLLING MACHINE

BACKGROUND OF THE INVENTION

The present invention relates to a universal rolling machine for rolling shape steel such as an H-beam or I-beam, which is provided with a pair of upper and lower horizontal rolls and a pair of left and right vertical rolls positioned on axial centers intersecting the axial centers of these horizontal rolls. More specifically, the invention relates to a die type of universal rolling machine wherein the vertical rolls move along the direction of travel (so-called as "the rolling direction") of the material being rolled, such as shape steel.

The vertical rolls of a conventional universal rolling machine are usually idle rolls whereas the pair of upper and lower horizontal rolls are driven rolls. When such an universal rolling machine is rolling an H-beam, for example, flanges could come into contact with the vertical rolls before a web located at the center of the flanges is sandwiched between the horizontal rolls, depending on the thickness of the flanges. The worst case that could happen in the rolling is the material being rolled is not gripped by the rolling machine. Further, if the flanges start the rolling operation in a state in which they are in contact with the vertical rolls, this could lead to a deterioration of quality of the shape steel due to the position of the web slipping from the center of the flanges and the web becoming rolled into a wavy shape. That is why a universal rolling machine has recently been proposed, configured such that the vertical rolls can move along the direction of travel of the material to be rolled.

Examples of this type of rolling machine are disclosed in Japanese Patent Laid-Open (KOKAI) Nos. Hei 4-172115 and Sho 57-97807. Each of these rolling machines is provided with vertical rolls within vertical roll chocks that are free to move in the direction of travel of the material to be rolled, and a movement mechanism for the vertical rolls is incorporated into the chocks.

However, the universal rolling machines disclosed in the above Japanese patent documents have the following problems:

1) Since the movement mechanism for the vertical rolls is incorporated into the vertical roll chocks, the configuration of the chocks is complicated.
2) Since the movement mechanism for the vertical rolls is fitted into limited spaces within the vertical roll chocks, many restrictions are imposed on the configuration and dimensions of the movement mechanism. Moreover, a load of several hundred tonnes is usually applied to the vertical rolls in the axial direction of the horizontal rolls during the rolling and a load of several tens of percent of this load is applied in the direction perpendicular to the axial centers of the horizontal rolls, so that the rolls must be supported fixedly in both these directions. It is extremely difficult to ensure sufficient strength for the vertical roll chocks incorporating the movement mechanism to bear these rolling reactive forces.
3) The incorporation of the movement mechanism into the vertical rolls greatly increases the construction costs of the vertical roll chocks. Since a minimum of three or four of these vertical roll chocks must always be kept ready for replacing the rolls, this greatly increases the equipment expenses and is also a factor in pushing up the equipment costs.
4) The rolling machine disclosed in the above mentioned Japanese Patent Laid-Open (KOKAI) No. Hei 4-172115 uses hydraulic cylinders as the movement mechanism, but since this configuration makes it necessary during a replacement of rolls (chocks) to remove and reattach the hydraulic piping that supplies hydraulic fluid to these hydraulic cylinders, the time required for the replacement is extended and thus the work efficiency decreases.
5) Since there is usually no more than about 0.3 to 0.5 mm of space between the vertical roll chocks and the housing, replacing the vertical roll chocks is difficult.

SUMMARY OF THE INVENTION

The present invention was devised in the light of the above described problems with the prior art, and has as its objective the provision of a universal rolling machine that not only enables the use of vertical roll chocks of a conventional construction, ensures sufficient strength with respect to the reactive forces applied to the vertical rolls during the rolling, and enables a reduction in constructions costs, but also enables a shortening of the time required for replacing rolls, by performing movement of the vertical rolls for each of the vertical roll chocks.

To achieve the above objective, the universal rolling machine of the present invention relates to a universal rolling machine provided with a pair of upper and lower horizontal rolls and a pair of left and right vertical rolls positioned on axial centers that intersect axial centers of these horizontal rolls. This universal rolling machine further comprises: a vertical roll chock corresponding to each of the vertical rolls, wherein each vertical roll chock is arranged to be free to slide along a direction of travel of the material to be rolled (hereinafter called the direction of rolling) within the housing of the rolling machine; and a movement mechanism for each vertical roll chock, provided either side of the vertical roll chock within a space between the vertical roll chock and the housing.

When the vertical rolls are moved by the universal rolling machine of the present invention with the above described configuration, the vertical roll chock is pushed in the direction of movement of the vertical roll by the movement mechanism for the vertical roll chock that is on one side of the vertical roll chock and is arranged within the space between the housing and the vertical roll chock, and, at the same time, the movement mechanism on the other side absorbs this movement of the vertical roll chock. This moves the vertical roll together with the vertical roll chock in the direction of rolling with respect to the housing. Replacing the vertical roll is done by removing the vertical roll chock and installing a new vertical roll chock, in a state in which the opposing parts of the movement mechanism are retracted into the housing to increase the space around the vertical roll chock. The movement mechanism of this invention differs from that of the rolling machines of the conventional construction in that it is not incorporated within the chock, so there is absolutely no need for the work of removing and reattaching the piping between the movement mechanism (actuators) and the power source thereof. Since the vertical rolls are free to rotate but are axially supported in a fixed manner at a certain position in the corresponding vertical roll chocks, sufficient strength to enable them to sufficiently withstand the rolling reactive forces can be ensured.

DESCRIPTION OF THE PREFERRED EMBODIMENTS

[First Embodiment]

A universal rolling machine of a first embodiment of the present invention will be described below with reference to the accompanying drawings.

Figure 1:
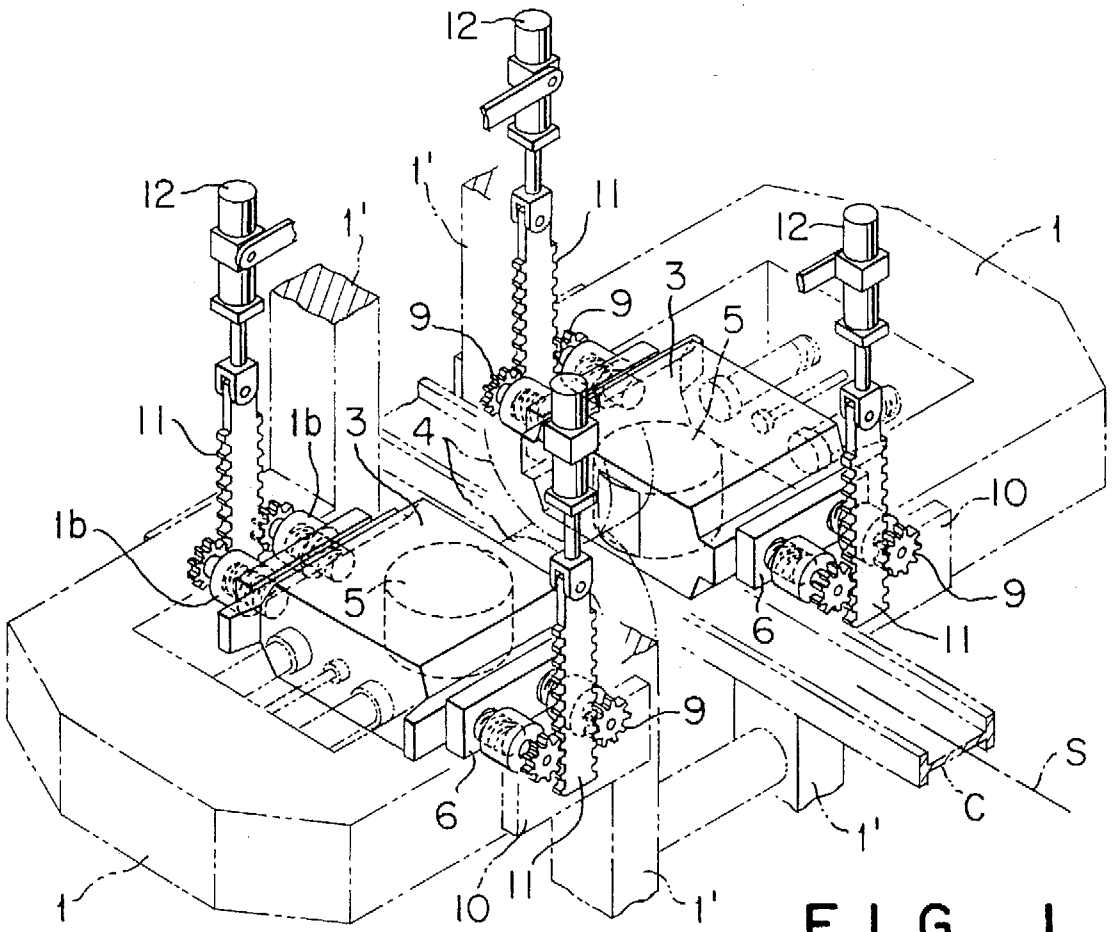
FIG. 1 is a perspective view of a universal rolling machine according to a first embodiment of the present invention.
Figure 2:
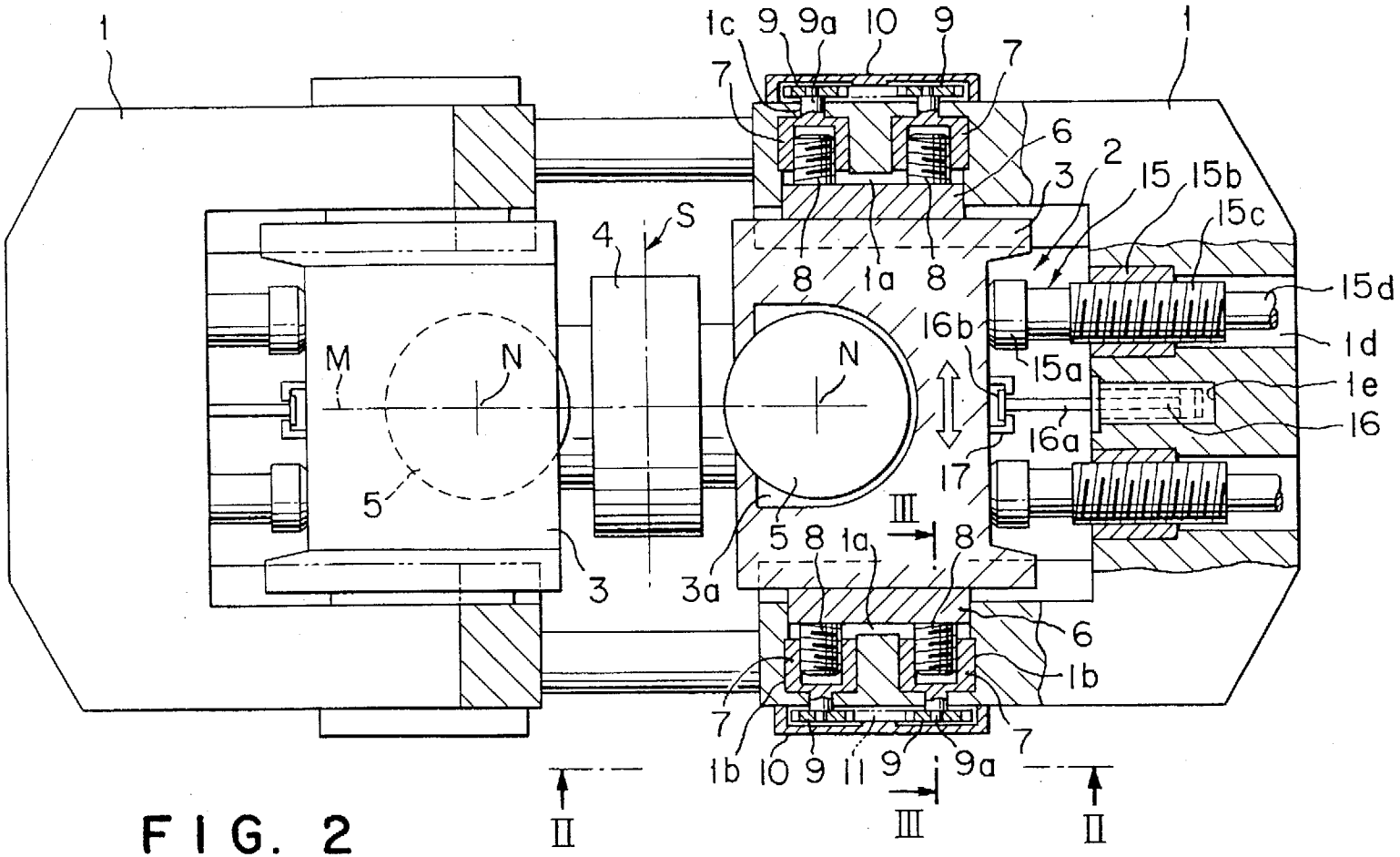
FIG. 2 is a plan view of the universal rolling machine as shown in FIG. 1, with only part of one vertical roll chock shown as a horizontal cross-sectional view.
Figure 3:
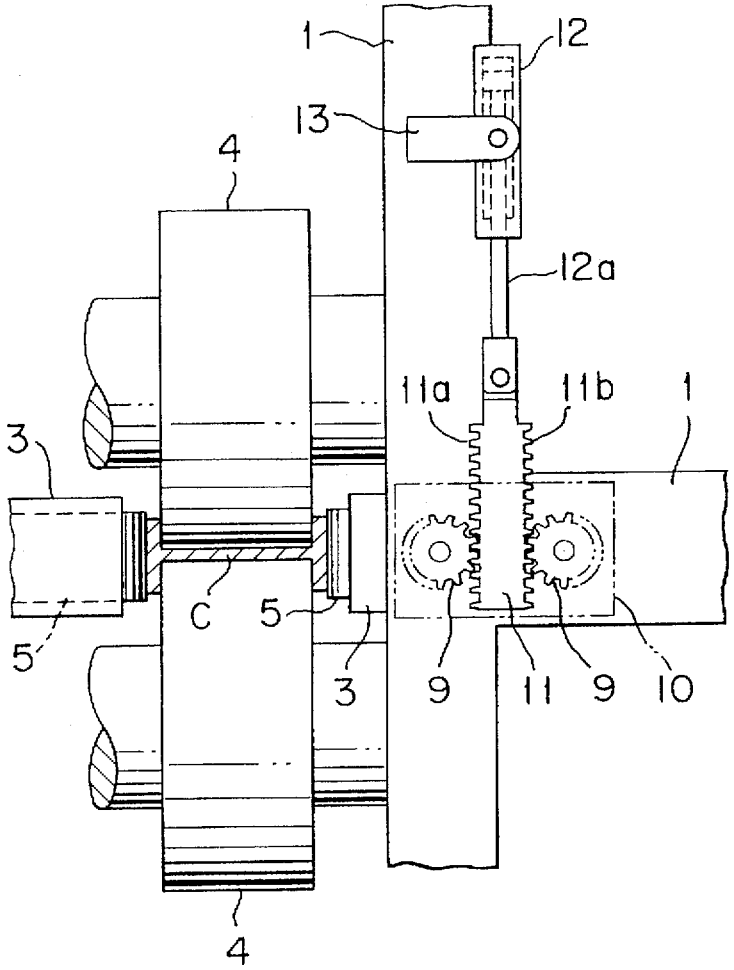
FIG. 3 is a view taken along the arrows II—II in FIG. 2.
Figure 4:
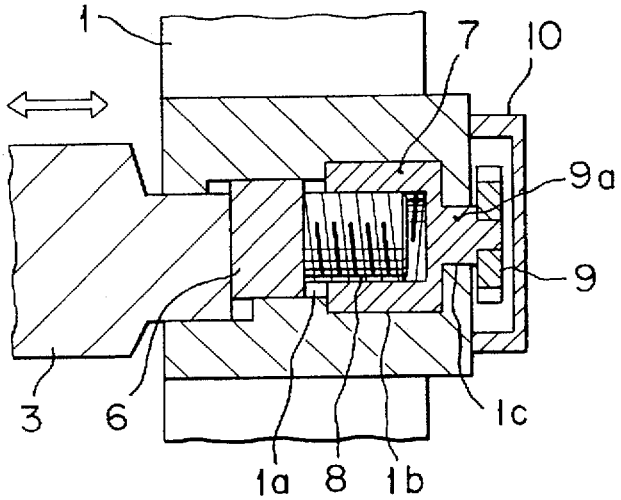
FIG. 4 is an enlarged cross-sectional view taken along the arrows III—III in FIG. 2.

A perspective view of a universal rolling machine acording to this first embodiment is shown in FIG. 1 and a plan view thereof, with only part of one vertical roll chock shown as a horizontal cross-sectional view is shown in FIG. 2, respectively. A view take along the arrows II—II in FIG. 1 is shown in FIG. 3, and a cross-sectional view taken along the arrows III—III thereof is shown in FIG. 4.

As shown in FIG. 1 and FIG. 2, two housings 1 of a U-shaped section that form part of the main body of the universal rolling machine are positioned symmetrically on either side of a center line S of the rolling machine. A vertical roll chock 3 is mounted within an aperture 2 of each housing 1. Each vertical roll chock 3 is configured such that the lateral cross-section thereof is approximately square and it can move within the corresponding aperture 2 in both a direction parallel to the center line S, in other words a rolling direction, and a direction perpendicular to the center line S (hereinafter, this is called the direction perpendicular to rolling). A material to be rolled C, such as an H-beam, travels along the center line S (see FIGS. 2 and 3). Note that a horizontal roll 4 is arranged above the material to be rolled C, facing another horizontal roll 4 therebelow (see FIG. 3). The left and right housings 1 are linked integrally by upper and lower housings, in such a manner that the entire assembly forms a loop shape to configure the rolling machine (see FIGS. 1 and 2).

Returning to FIG. 1 and FIG. 2, an aperture 3*a* is formed in a central portion of each vertical roll chock 3, a vertical roll 5 is axially supported in each aperture 3*a* in a freely rotatable manner, and part of each vertical roll 5 protrudes from the corresponding vertical roll chock 3 toward the path of travel of the material to be rolled. Central axes N of the vertical rolls 5 are perpendicular to central axes M of the horizontal rolls 4. A slide opening 1*a* is formed passing through each aperture 2 in the front and rear of the housings 1, and a slide plate 6 is inserted through each slide opening 1*a* in such a manner that it is free to slide parallel to the center line S. Two indentations 1*b* of a circular cross-section are formed symmetrically passing through each of the slide openings 1*a*, and a circular cylindrical nut 7 with one end open is inserted into each indentation 1*b* in a freely rotatable manner. A female screw-thread portion is formed on the inner peripheral surface of each nut 7, an outer peripheral surface of a screw 8 is formed into a male screw-thread portion that engages in a freely rotatable manner with this female screw-thread portion, and one end surface of the screw 8 is fixed integrally to the corresponding slide plate 6.

A through-hole 1*c* is bored through each indentation 1*b*, and pinions 9 outside the housings 1 are linked integrally to the nuts 7 by linkage portions 9*a* that are inserted loosely within these through-holes 1*c*. The front and rear slide plates 6 are positioned on either side of the vertical roll chock 3 and are adjusted such that one edge of each slide plate 6 is ordinarily in mutually contact with the vertical roll chock 3. The thread directions of the screws 8 that face each other to front and rear are opposite, as are the thread directions of adjacent screws 8 at the front and at the rear. A common cover 10 is provided over each pair of pinions 9.

Each pair of pinions 9 is rotated simultaneously by the linear movement of a rack 11 provided with horizontal teeth 11*a* and 11*b* that engage with the corresponding pinions 9, as shown in FIG. 3. That is, a hydraulic cylinder 12 such as an oil cylinder is attached to a vertical portion 1' of the housing 1 by a support member 13. The hydraulic cylinder 12 is pinned to the support member 13 and a forward end of a piston rod 12*a* thereof is pinned to a base edge of the rack 11. Therefore, the rack 11 is moved by the expansion or contraction of the piston rod 12*a* of the hydraulic cylinder 12, and thus the pinions 9 are simultaneously rotated. This rotates the pair of nuts 7 in opposite directions, and thus the pair of screws 8 advance or retreat with respect to the nuts 7. During this time, the front and rear hydraulic cylinders 12 on either side of the direction of rolling are linked and controlled to move the racks 11 on mutually opposite sides by exactly the same distance in the opposite direction. As a result, the nuts 7 on mutually opposite sides also rotate in opposite directions, but, since the screw-threads of the corresponding screws 8 are formed in opposite directions, one screw 8 moves forward while the opposite screw 8 retreats. Moreover, each vertical roll chock 3 is set to move forward or backward along the rolling direction (in other words, toward the entrance or exit for the material to be rolled) via the slide plates 6.

Each vertical roll chock 3 is also mounted within the housing 1 so as to be free to slide in a direction perpendicular to the rolling direction (so-called the lateral direction), in a state wherein it is sandwiched between slide plates 6 to the front and rear of the rolling direction, as described above. A pair of pressure devices 15 and a drawing device 16 positioned therebetween are provided as a mechanism for moving the vertical roll chocks 3 in the direction perpendicular to rolling (see FIG. 2). In this first embodiment, each pressure device 15 is formed as a pressurizing screw provided at a tip of a head portion 15*a* in contact with the corresponding vertical roll chock 3, and a screw-thread portion 15*c* of each of these pressurizing screws 15 engages in a freely rotatable manner with a slip-nut 15*b* inserted in a mounting hole bored in the lateral direction of the housing 1. An operating rod 15*d* is attached to the base end of each of these pressurizing screws 15, part of this operating rod 15*d* protrudes outward from a through-hole 1*d*, and the configuration is such that the vertical roll chocks 3 and vertical rolls 5 can be moved into mutual contact by rotating the operating rods 15*d* from the outside of the housings 1.

The drawing device 16 is formed of a hydraulic cylinder such as an oil cylinder, a mounting hole 1*e* extending in the direction perpendicular to the rolling is formed in the housing 1 to connect with the apperture 2, and the main portion of the drawing device 16 is inserted into this mounting hole 1*e*. A circular plate-shaped retaining portion 16*b* is fixed to the tip of a piston rod 16*a* and this piston rod 16*a* engages with hook-shaped retaining pieces 17 fixed to an end surface of the vertical roll chock 3, thus linking the piston rod 16*a* and the vertical roll chock 3 together. Therefore, since a space is formed between the retaining pieces 17 and the piston rod 16*a* and also the head portions 15*a* of the pressurizing screws 15 are simply in contact with the vertical roll chock 3, the vertical roll chock 3 is permitted to move along the direction of rolling. Movement in the direction that mutually separates the vertical roll chocks 3 and the vertical rolls 5 in the direction perpendicular to the rolling is achieved by rotating the operating rods 15*d* in reverse so that each of the front and rear pressurizing screws 15 are retracted to compress the piston rods 16*a* of the hydraulic cylinders 16, which are set to the corresponding tensile force to cause the weight of the vertical roll chocks 3 including the vertical rolls 5 to move.

The description now turns to the operation of moving the vertical rolls 5 in the rolling direction, in the universal rolling machine according to this first embodiment that is configured as described above.

As shown in FIG. 3, the left and right vertical rolls 5 are each moved toward an exit side of the rolling machine during the operation of rolling a material such an H-beam, along the direction of rolling of the H-beam C which is the material to be rolled. However, of the hydraulic cylinders 12 of this embodiment, located in four places in front, in the rear, and to the left and right, as shown in FIG. 1 and FIG. 2, the piston rods 12*a* of the two on the entrance side extend while the piston rods 12*a* of the two on the exit side contract to move the corresponding racks 11 either downward or upward. This rotates the pinions 9 in mutually opposite directions so that the nuts 7 shown in FIG. 2 turn together, and the screws 8 on the entrance side move forward with respect to the nuts 7, in other words, the screw/nut assemblies extend. On the other hand, the screws 8 on the exit side move backward with respect to those nuts 7, in other words, the screw/nut assemblies contract, and thus the vertical roll chocks 3 move toward the exit side of the rolling machine via the slide plates 6.

During this time, there will be sliding movement between each vertical roll chock 3 and the head portions 15*a* of the corresponding pressurizing screws 15, and the positions of the retaining pieces 17 will move with respect to the retaining portion 16*b* at the tip of each piston rod 16*a*, but the amount of movement of each vertical roll chock 3 is ordinarily only a few tens of millimeters so that the spacing between the retaining pieces 17 and the corresponding piston rods 16*a* can be of the order of that shown in FIG. 2. This means that the vertical rolls 5 move toward the exit side of the rolling machine along the direction of rolling of the H-beam C which is the material to be rolled. In this first embodiment of the present invention, the assemblies of screws 8 and nuts 7 can be accommodated within a comparatively restricted space, and a function that holds the vertical roll chocks 3 in a certain position, which is a self-locking function, can be achieved by selection of the screw pitch of the threaded portions of the screws 8 and nuts 7.

[Second Embodiment]

Figure 5:
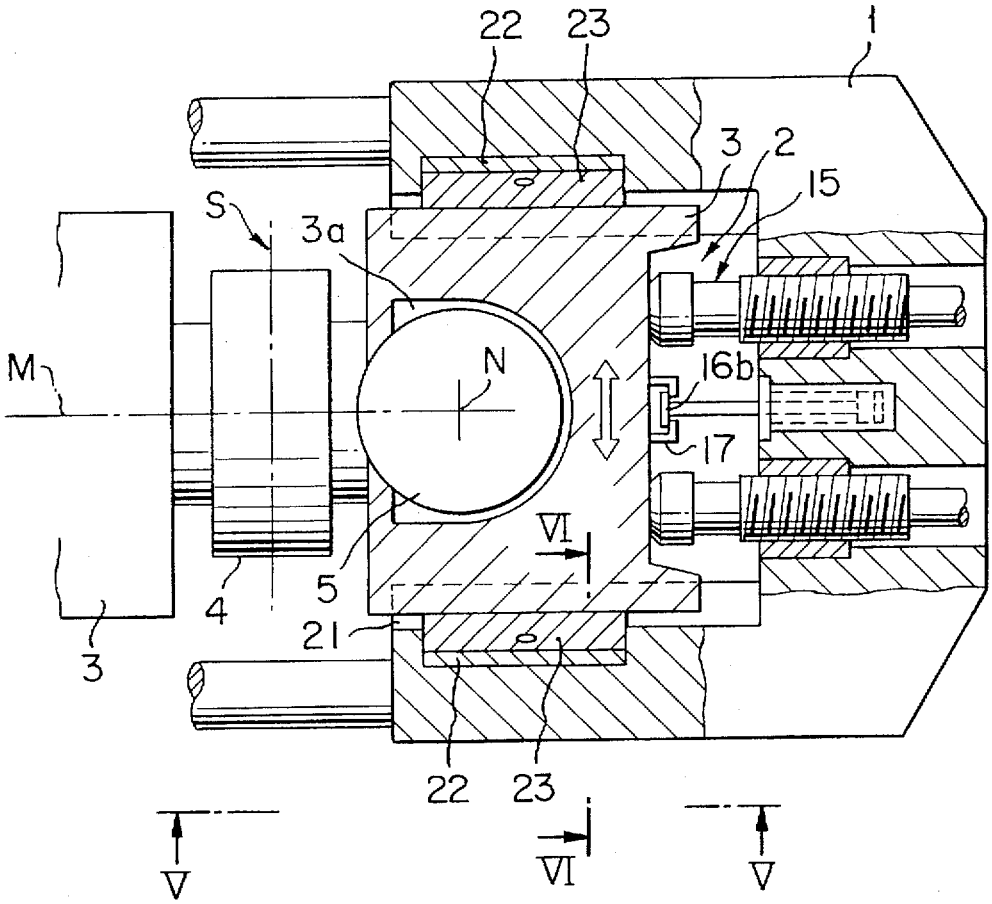
FIG. 5 is a plan view of a universal rolling machine acording to a second embodiment of the present invention, with only part of one vertical roll chock shown as a horizontal cross-sectional view.
Figure 6:
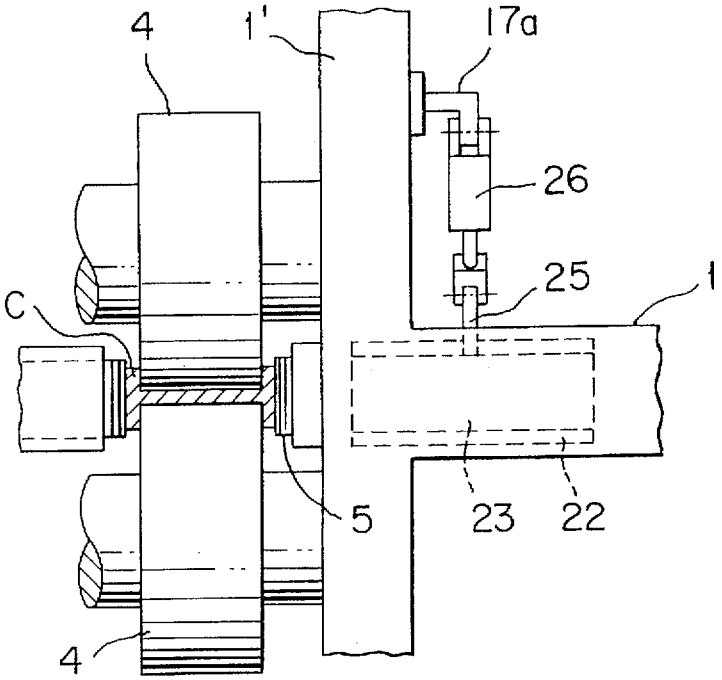
FIG. 6 is a view taken along the arrows V—V in FIG. 5.
Figure 7:
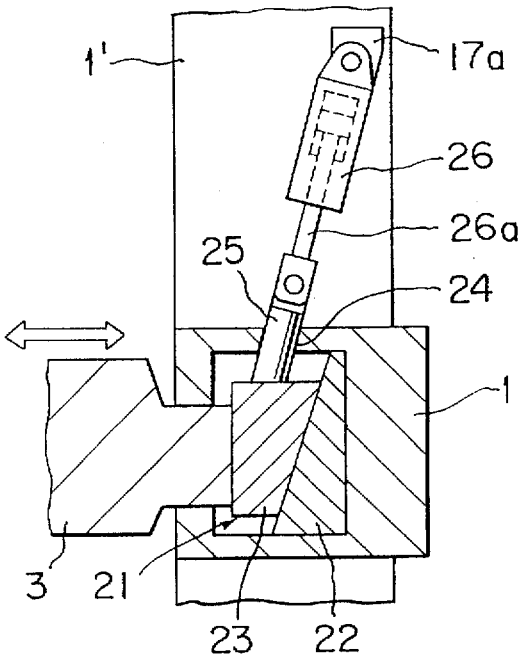
FIG. 7 is a cross-sectional view taken along the arrows VI—VI in FIG. 5.

A second embodiment of the universal rolling machine of the present invention is shown in FIG. 5 to FIG. 7. The rolling machine of the second embodiment differs from that of the above first embodiment solely in the mechanism for moving the vertical roll chocks 3. That is, indented accommodation apertures 21 in front and rear portions of each housing 1 are provided facing the aperture 2, and a fixed wedge member 22 having a surface that slopes from an upper edge to a lower edge toward the vertical roll chock 3 is fixed in each of these accommodation apertures 21 in the housing 1, as shown in FIG. 7. A movable wedge member 23 having an oblique surface corresponding to the oblique surface of the fixed wedge member 22 is inserted into each accommodation aperture 21. A through-hole 24 that is inclined parallel to the oblique surface of the fixed wedge member 22 is bored in the housing 1, an operating rod 25 protrudes from an upper edge of each movable wedge member 23 toward the corresponding through-hole 24, and the end of the operating rod 25 that protrudes from the through-hole 24 is pinned to the tip of a piston rod 26*a* of a hydraulic cylinder 26. The base end of the hydraulic cylinder 26 is pinned to a tip portion of an L-shaped bracket 17*a* fixed to a vertical portion 1' of the housing 1, as shown in FIG. 6 and FIG. 7. Each of the movable wedge members 23 to the front and rear along the rolling direction is set in such a manner that a vertical edge surface of the movable wedge member 23 is in contact with a vertical edge surface of the vertical roll chock 3 in a state in which it has moved to an intermediate position in the vertical direction, as shown in FIG. 7. Since the rest of the configuration of this embodiment is common to that of the above described first embodiment, the same components are given the same reference numbers, and further description thereof is omitted.

Movement along the rolling direction of the vertical rolls 5 in the universal rolling machine of this second embodiment is implemented as described below. The configuration could be such that, when, for example, the vertical rolls 5 move towards the exit side of the rolling machine, the piston rods 26*a* of the hydraulic cylinders 26 extend and the movable wedge members 23 on the entrance side move downward. At the same time, the piston rods 26*a* of the hydraulic cylinders 26 on the entrance side contract in response to this movement, and those movable wedge members 23 move upward. With this second embodiment, the mechanical strength of the movement mechanism, in other words, the wedge members 22 and 23, can be made great enough to bear the reaction applied to the vertical rolls 5 during the rolling. The amount of movement of the movable wedge member 23 can be increased by reducing the angle of the oblique surfaces of the wedge members, but they could also be made to have a holding function, which is a self-locking function, for holding the vertical roll chocks 3 in a certain position.

[Third Embodiment]

Figure 8:
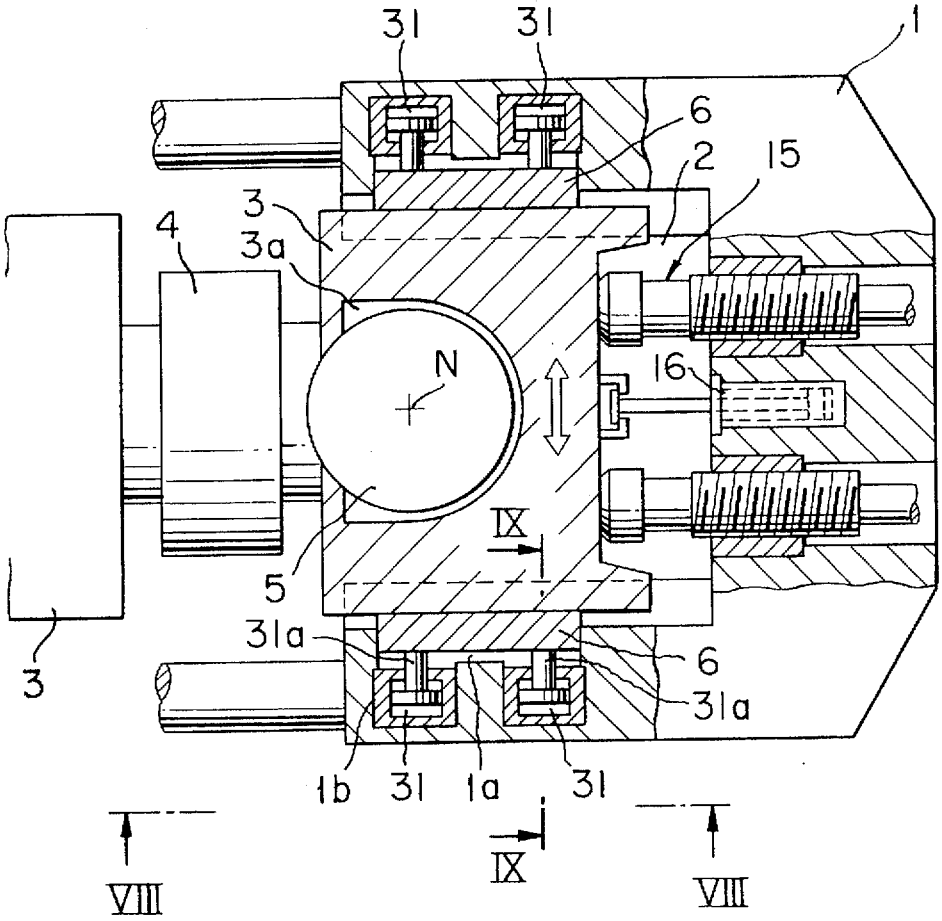
FIG. 8 is a plan view of a universal rolling machine according to a third embodiment of the present invention, with only part of one vertical roll chock shown as a horizontal cross-sectional view.
Figure 9:
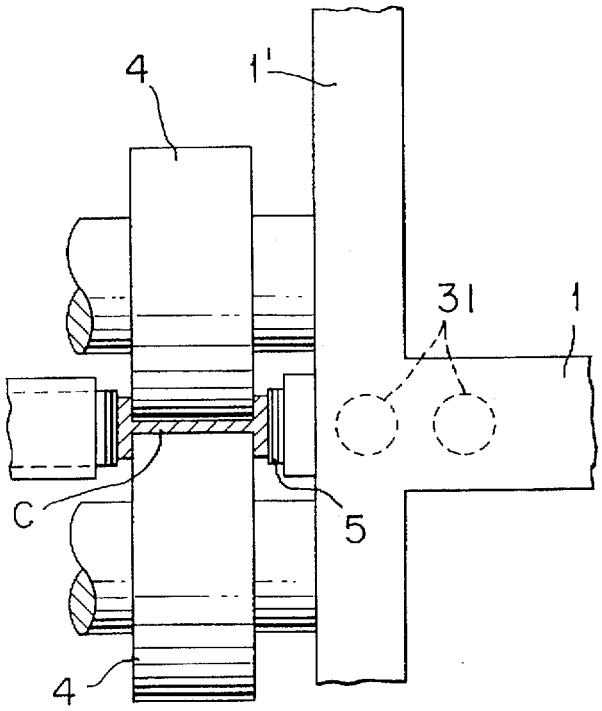
FIG. 9 is a view taken along the arrows VIII—VIII in FIG. 8.
Figure 10:
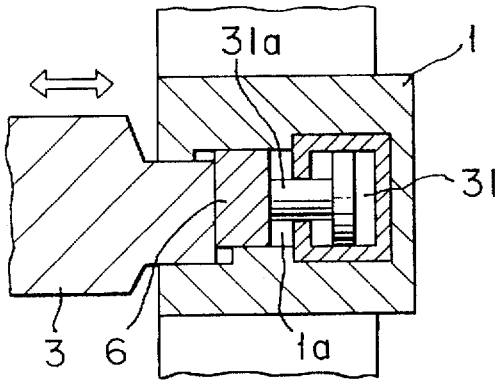
FIG. 10 is a cross-sectional view taken along the arrows IX—IX in FIG. 8.

A third embodiment of the universal rolling machine of the present invention is shown in FIG. 8 to FIG. 10. The rolling machine of the third embodiment differs from that of the above first embodiment solely in the mechanism for moving the vertical roll chocks 3. That is, a hydraulic cylinder 31 such as an oil cylinder is inserted into each of the above described indentations 1*b*, and the tip of an piston rod 31*a* of each hydraulic cylinder 31 is fixed to the corresponding slide plate, as shown in FIG. 8 to FIG. 10. Since the rest of the configuration of this embodiment is common to that of the above described first embodiment, the same components are given the same reference numbers, and further description thereof is omitted.

Movement along the rolling direction of the vertical rolls 5 in the universal rolling machine of this third embodiment is implemented as described below. The configuration could be such that, when, for example, the vertical rolls 5 move towards the exit side of the rolling machine, the piston rods 31*a* of the hydraulic cylinders 31 on the entrance side extend so that the vertical roll chock 3 is pushed toward the entrance side on the slide plate 6. At the same time, the piston rods 31*a* of the hydraulic cylinders 31 on the exit side contract in answer to this movement. With this third embodiment, the hydraulic cylinders 31 can be accommodated into the comparatively restricted spaces of the indentations 1*b* or the like, making the entire apparatus more compact. There are no sliding members such as screw/nut assemblies or wedge members, enabling faster movement.

[Fourth Embodiment]

Figure 11:
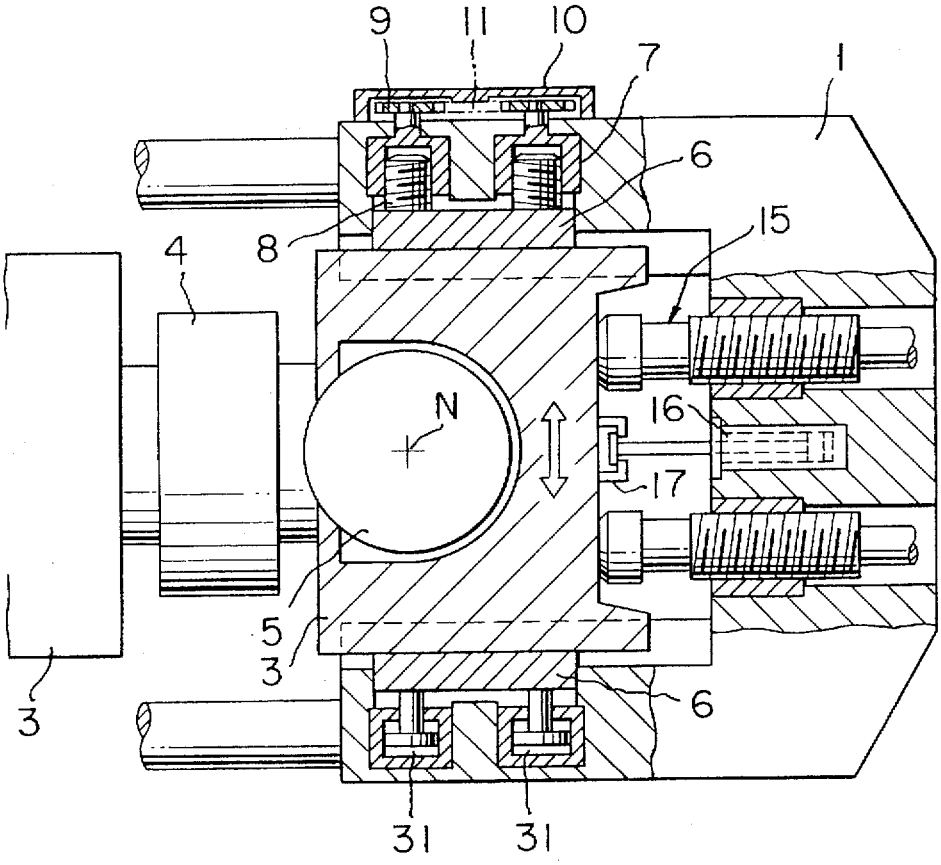
FIG. 11 is a plan view of a universal rolling machine according to a fourth embodiment of the present invention, with only part of one vertical roll chock shown as a horizontal cross-sectional view.

A fourth embodiment of the universal rolling machine of the present invention is shown in FIG. 11. The rolling machine of the fourth embodiment differs from that of the above first embodiment in that a combination of the movement mechanisms of the first and third embodiments is used to move the vertical roll chocks 3. That is, assemblies of screws and nuts are used on one side of each vertical roll chock 3 in the direction of rolling, as shown in FIG. 11, and hydraulic cylinders 31 are used on the other side. Since the rest of the configuration of this embodiment is common to that of the above described first embodiment, the same components are given the same reference numbers, and further description thereof is omitted.

Movement of the vertical rolls 5 along the direction of rolling in this universal rolling machine of this fourth embodiment is achieved as described below. The configuration could be such that, when, for example, the vertical rolls 5 move towards the side of the rolling machine on which the hydraulic cylinders 31 are provided, the piston rods 12*a* of the hydraulic cylinders 12 (see FIG. 3) extend, moving the rack 11 downward and thus causing the left and right pinions 9 to rotate simultaneously, the screws 8 push outward via the nuts 7, and the vertical roll chock 3 presses toward the side on which the hydraulic cylinders 31 are provided and, at the same time, the piston rods 31*a* of the hydraulic cylinders 31 contract in response to this movement. In this fourth embodiment, the assemblies of the screws 8 and nuts 7 are used to determine the position of the vertical roll chocks 3 and rattling of the vertical roll chocks 3 can be prevented by the application of pressure in the reverse direction by the manner in which the hydraulic cylinders 31 follow this movement.

[Fifth Embodiment]

Figure 12:
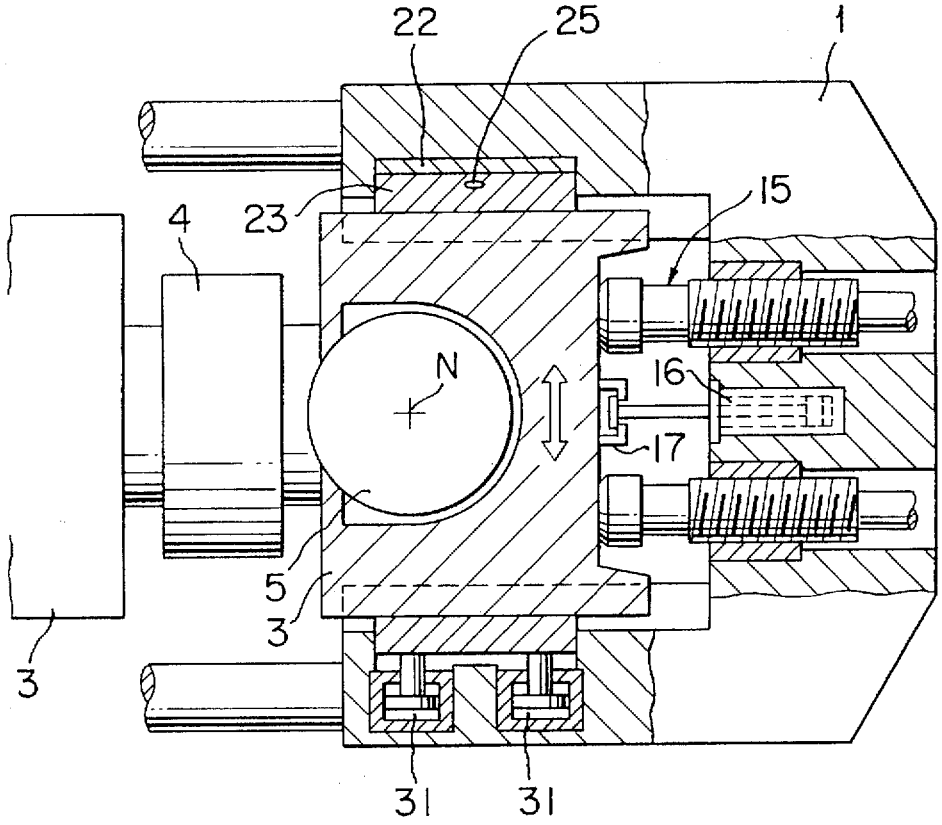
FIG. 12 is a plan view of a universal rolling machine according to a fifth embodiment of the present invention, with only part of one vertical roll chock shown as a horizontal cross-sectional view.

A fifth embodiment of the universal rolling machine of the present invention is shown in FIG. 12. The rolling machine of the fifth embodiment differs from that of the above first embodiment in that a combination of the movement mechanisms of the second and third embodiments is used to move the vertical roll chocks 3. That is, assemblies of fixed wedge members 22 and movable wedge members 23 are used on one side of each vertical roll chock 3 in the direction of rolling, as shown in FIG. 12, and hydraulic cylinders 31 are used on the other side. Since the rest of the configuration of this embodiment is common to that of the above described first embodiment, the same components are given the same reference numbers, and further description thereof is omitted.

Movement of the vertical rolls 5 along the direction of rolling in this universal rolling machine of this fifth embodiment is achieved as described below. The configuration can be such that, when, for example, the vertical rolls 5 move towards the exit side of the rolling machine, the piston rods 26*a* of the hydraulic cylinders 26 extend and the movable wedge members 23 move downward and, at the same time, the piston rods 31*a* of the hydraulic cylinders 31 contract in response to this movement. This fifth embodiment can prevent rattling of the vertical roll chocks 3 in the same manner as the fourth embodiment (see FIG. 11).

A number of embodiments of the present invention have been described above, but it should be obvious to those skilled in the art that the universal rolling machine of the present invention is not limited thereto, provided that embodiments thereof conform to the following conditions:

1) Of the screw/nut assemblies, a configuration is preferable in which nuts 7 are fixed to the slide plates 6 and the assemblies on the same side are either extended or contracted by causing screws 8 linked to the pinions 9 to rotate.
2) The nuts of the screw/nut assemblies are preferably fixed to the housings 1, one end of each screw 8 is linked in a freely rotatable manner to the corresponding slide plate 6, pinions 9 at the other end thereof are arranged in such a manner that they are free to move in the axial direction of the slide plate but are restrained in the rotational direction, and screws 8 are moved in the direction of rolling by the rotation of these screws 8.
3) A fixed wedge member 22 could be fixed to the vertical roll chock 3, the fixed wedge member 22 in the accommodation apertures 21 can be provided between the housings 1 with the movable wedge member 23 therebetween, and the vertical roll chock 3 can be made to move in the direction of rolling by the movement of the movable wedge member 23.

As is clear from the above description, the universal rolling machine of the present invention has the following effects:

1) Vertical roll chocks that are standard in the prior art can be used, sufficient mechanical strength with respect to the reactive forces applied to the vertical rolls can be ensured during the rolling, and construction costs can be reduced, and, in addition, the time required for replacing vertical rolls can be reduced because there is no need for work such as removing and reconnecting the piping for the power source of the movement mechanisms (for example, the actuators).
2) The spacing of the left and right vertical rolls can be adjusted in the direction perpendicular to rolling, in accordance with changes in the dimensions of the material to be rolled, even though the vertical roll chocks are positioned in the direction of rolling within the movement range thereof.
3) The movement mechanism of the rolling machine of this invention can accommodate the screw/nut assemblies, even in a comparatively restricted space, and a self-locking function for holding the vertical roll chocks in a certain position can be provided by suitable setting of the pitch of the threads of the engagement portions of the screws and nuts.
4) The movement mechanism of the rolling machine of this invention enables an increase in the mechanical strength of the wedge members, ensures sufficient resistance to the reactive forces applied to the vertical rolls during the rolling, and makes it possible to provide a self-locking function for the vertical roll chocks by suitable selection of the angle of the oblique surfaces of the wedge members.

5) The movement mechanism of the rolling machine of this invention enables accommodation of hydraulic cylinders 31 within a restricted space, thus enabling a more compact apparatus, and, since there are fewer frictional members in the screw/nut assemblies or wedge portions than in components used by other methods, the vertical roll chocks can be moved at high speed. Further, rattling of the vertical roll chocks can be prevented by using the hydraulic cylinders on one side to determine the position in the direction of movement and the balancing force of the hydraulic cylinders on the other side to press the vertical roll chocks toward the positioning side.

6) The movement mechanism of the rolling machine of this invention can prevent rattling of the vertical roll chocks by using the screw/nut assemblies or wedge portions to determine the position of the vertical roll chocks and applying balancing pressure in the opposite direction by the hydraulic cylinders to follow this movement.

What is claimed is:

1. A universal rolling machine comprising:

a pair of upper and lower horizontal rolls having parallel horizontal axes, respectively;

a pair of left and right vertical rolls positioned at opposite sides of said horizontal rolls and having vertical axes, respectively, that intersect said horizontal axes;

a housing for said horizontal and vertical rolls;

a pair of vertical roll chocks mounted within said housing to be slidable in a transverse direction parallel to said horizontal axes and along a rolling centerline on which a material being rolled is sent and which extends perpendicularly to said transverse direction, said vertical roll chocks being disposed on opposite sides of said rolling centerline and having opposing apertures, respectively, in mutually facing sides of the chocks, said apertures receiving therein said vertical rolls in a manner rotatable around said vertical axes, said vertical roll chocks having end portions extending into slide openings formed in said housing so as to be mounted slidably along said rolling centerline; and movement mechanisms for sliding said vertical roll chocks along said rolling centerline, said movement mechanisms being disposed along said housing to act on said end portions of the vertical roll chocks, respectively.

2. The universal rolling machine according to claim 1, wherein:

said vertical roll chocks are provided within said housing in such a manner that they are also free to slide in an axial direction of the horizontal rolls; and devices for pushing and drawing said vertical roll chocks in the axial direction of said horizontal rolls are provided between said housing and said vertical roll chocks in such a manner as to permit movement thereof along the rolling centerline.

3. The universal rolling machine according to claim 1, wherein:

each of said movement mechanisms of said vertical roll chocks is configured of an assembly consisting of a circular cylindrical nut provided with a female screw-thread on an inner peripheral surface thereof and a screw having a male screw-thread engaging in a freely rotatable manner with said female screw-thread of said nut; and said circular cylindrical nut or screw on one side of said screw/nut assembly of said vertical roll chocks while said vertical roll chocks are moving is rotated in a direction that extends said screw/nut assembly at the same time that said circular cylindrical nut or screw on the other side thereof is rotated in a direction that contracts said screw/nut assembly.

4. The universal rolling machine according to claim 1, wherein:

each of said movement mechanisms of said vertical roll chocks is configured of a fixed wedge member attached to said housing and a movable wedge member that is in freely slidable contact with said fixed wedge member and said corresponding vertical roll chock, whereby said movable wedge member on one side of said vertical roll chocks moves downward while said movable wedge member on the other side thereof is moved simultaneously in a mutually opposite direction so as to move said vertical roll chocks.

5. The universal rolling machine according to claim 1, wherein:

each of said movement mechanisms of said vertical roll chocks is configured of a hydraulic cylinder; and said hydraulic cylinder on one side of said vertical roll chocks while said vertical roll chocks are moving is extended at the same time that said hydraulic cylinder on the other side thereof is contracted.

6. The universal rolling machine according to claim 1, wherein:

each of said movement mechanisms of said vertical roll chocks is configured of a hydraulic cylinder and an assembly consisting of a circular cylindrical nut provided with a female screw-thread on an inner peripheral surface thereof and a screw having a male screw-thread engaging in a freely rotatable manner with said female screw-thread of said nut; and said circular cylindrical nut or screw on one side of said vertical roll chocks while said vertical roll chocks are moving is rotated in a direction that either extends or contracts said screw/nut assembly at the same time that said hydraulic cylinder on the other side thereof is either contracted or extended.

7. The universal rolling machine according to claim 1, wherein:

each of said movement mechanisms of said vertical roll chocks is configured of a hydraulic cylinder and an assembly of a fixed wedge member attached to said housing and a movable wedge member that is in freely slidable contact with said fixed wedge member and said corresponding vertical roll chock, whereby said movable wedge member on one side of said vertical roll chocks moves downward so as to move said vertical roll chocks in one direction by moving a piston rod of said hydraulic cylinder downwardly.

8. The universal rolling machine according to claim 1, wherein:

said movement mechanisms are disposed within said housing.

* * * * *